US007768460B2

(12) United States Patent
Yang et al.

(10) Patent No.: US 7,768,460 B2
(45) Date of Patent: Aug. 3, 2010

(54) MULTI-BAND ANTENNA

(75) Inventors: Wen-Chieh Yang, Tu-Cheng (TW); Yu-Yuan Wu, Tu-Cheng (TW); Kai Shih, Tu-Cheng (TW); Hsin-Tsung Wu, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 110 days.

(21) Appl. No.: 12/178,945

(22) Filed: Jul. 24, 2008

(65) Prior Publication Data

US 2010/0019973 A1 Jan. 28, 2010

(51) Int. Cl.
*H01Q 1/38* (2006.01)
*H01Q 19/10* (2006.01)

(52) U.S. Cl. ..... 343/700 MS; 343/818

(58) Field of Classification Search ..... 343/700 MS, 343/818, 846, 866

See application file for complete search history.

(56) References Cited

U.S. PATENT DOCUMENTS 7,050,010 B2 * 5/2006 Wang et al. ..... 343/702
7,119,748 B2 * 10/2006 Autti ..... 343/702
7,319,432 B2 * 1/2008 Andersson ..... 343/702
2008/0180333 A1 * 7/2008 Martiskainen et al. ..... 343/722

* cited by examiner

*Primary Examiner*—Shih-Chao Chen
(74) *Attorney, Agent, or Firm*—Muncy, Geissler, Olds & Lowe, PLLC

(57) ABSTRACT

A multi-band antenna has a grounding plate, a radiating element and a parasitic element. The radiating element has a level radiating portion disposed a predetermined distance away from the grounding plate and a first connecting portion connecting the level radiating portion with the grounding plate. The parasitic element has a substantially L-shaped parasitic portion away from the grounding plate and a second connecting portion disposed at the same side of the grounding plate with the first connecting portion to connect a free end of the L-shaped parasitic portion with the grounding plate. The L-shaped parasitic portion is substantially at the same plane with and spatially fences the level radiating portion to define a substantially L-shaped space. The multi-band antenna has simple structure and small size to be assembled in the limited space of notebook.

5 Claims, 2 Drawing Sheets

MULTI-BAND ANTENNA

BACKGROUND OF THE INVENTION

1. Field of the Invention

The present invention relates generally to an antenna, and more particularly to a multi-band antenna used in an electronic device.

2. The Related Art

In recent years, portable wireless communication devices, such as notebook, are becoming increasingly popular. In order to communicate with other communication devices, antenna installed within the notebook for transmitting and receiving electromagnetic waves is an important component that should be taken into account. In general terms, two antennas are embedded in a notebook, one of which is used for transmitting and receiving wide bandwidth signals and the other for receiving and radiating Bluetooth signals within a short distance.

However, considering the miniaturization trend of the notebook, the size of the antenna should be reduced in order that the antenna can be assembled in limited space of the notebook. Installing two antennas in notebook however, not only occupies more space, but also complicates antenna structure. Accordingly, it is desirable to have an antenna with simple structure to overcome the problem encountered in the prior art.

SUMMARY OF THE INVENTION

An object of the present invention is to provide a multi-band antenna having a grounding plate, a radiating element and a parasitic element. The radiating element has a level radiating portion disposed a predetermined distance away from the grounding plate and a first connecting portion connecting the level radiating portion with the grounding plate. The parasitic element has a substantially L-shaped parasitic portion away from the grounding plate and a second connecting portion disposed at the same side of the grounding plate with the first connecting portion to connect a free end of the L-shaped parasitic portion with the grounding plate. The L-shaped parasitic portion is substantially at the same plane with and spatially fences the level radiating portion to define a substantially L-shaped space for capacitively coupled with the level radiating portion to operate at a frequency band of about 2.4 GHz coving Bluetooth band.

As described above, the design of arranging a substantially L-shaped parasitic portion spatially fencing the level radiating portion for capacitively coupled with the level radiating portion reduces a single antenna for transmitting and receiving Bluetooth signal and makes the multi-band antenna have simple structure and small size to be assembled in the limited space of notebook.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
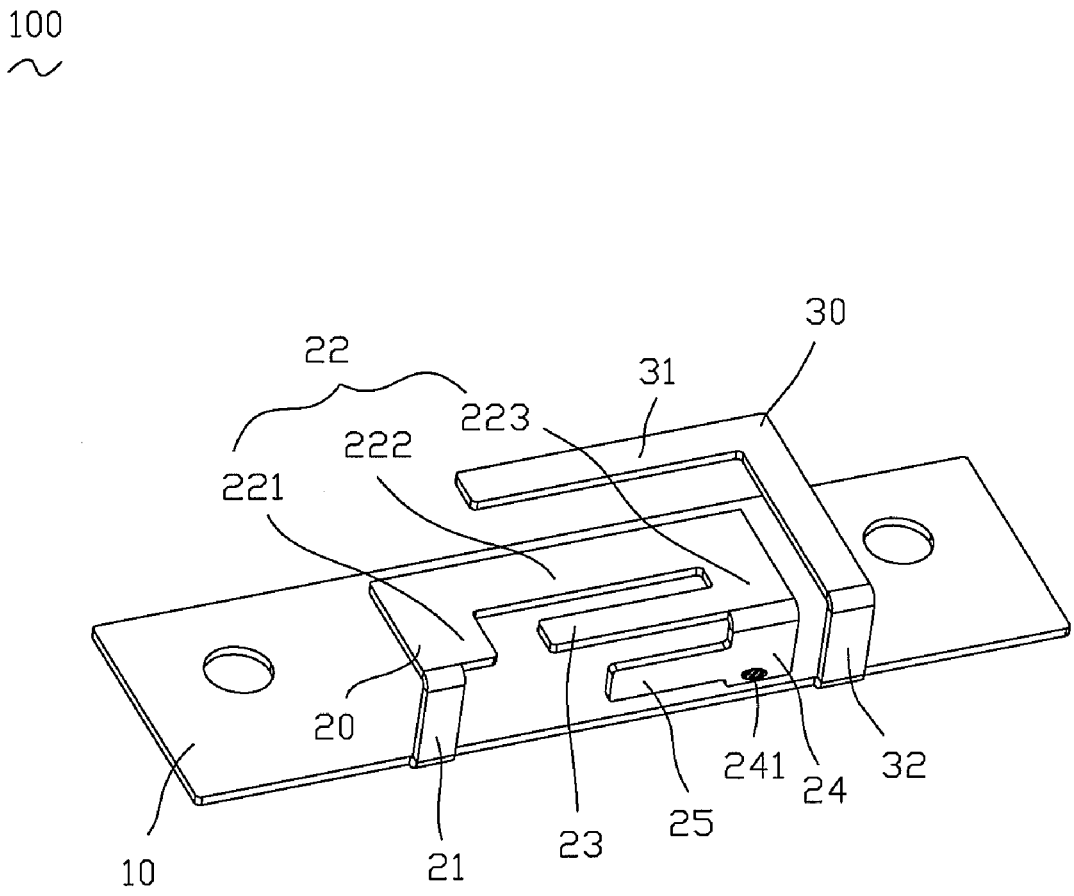
FIG. 1 is a perspective view of a multi-band antenna in accordance with the present invention.

With reference to FIG. 1, a multi-band antenna 100 according to the present invention is made of metal sheet and comprises a substantially rectangular grounding plate 10, a radiating element 20 extending from one side of the plate 10 and disposed on the plate 10, and a parasitic element 30 extending form the same side of the grounding plate 10 as the radiating element 20.

The radiating element 20 has a level radiating portion disposed a predetermined distance away from and parallel to the grounding plate 10 and a first connecting portion 21 connecting the level radiating portion with the grounding plate 10.

The level radiating portion has a substantially n-shaped base 22. The n-shaped base 22 has a long piece 222 and a left and a right short pieces 221, 223 both of which extend from two opposite sides of the long piece 222. The first connecting portion 21 is substantially vertically connected to a free end of the left short piece 221. The right short piece 223 extends towards the left short piece 221 to form a first radiating strip 23. A free end of the first radiating strip 23 is adjacent to the left short piece 221.

A free end of the right short piece 223 of the n-shaped base 22 extends towards the grounding plate 10 to form a feeder portion 24 near the grounding plate 10. The feeder portion 24 defines a feeder point 241 thereon for feeding the multi-band antenna 100. The feeder portion 24 extends towards the first connecting portion 21 to form a second elongated radiating strip 25. The second radiating strip 25 is shorter than the first radiating strip 23.

The parasitic element 30 has a substantially L-shaped parasitic portion 31 disposed a predetermined distance away from and parallel to the grounding plate 10 and a second connecting portion 32 connecting a free end of the L-shaped parasitic portion 31 with the grounding plate 10. The L-shaped parasitic portion 31 is substantially arranged at the same plane as the level radiating portion and spatially fences the long piece 222 and the right short piece 223 of the n-shaped base 22 to define a substantially L-shaped space for capacitively coupled with the level radiating portion.

When the multi-band antenna 100 is used in wireless communication, an electric current is fed into the multi-band antenna 100 via the feeder point 241. Antenna characteristic of the n-shaped base 22 of the radiating element 20 is similar to a loop antenna. The length of the n-shaped base 22 obtains a half of wavelength and resonates at a first high frequency band ranging from 3 GHz to 4 GHz.

Antenna characteristic of the first radiating strip 23 of the radiating element 20 is similar to a monopole antenna. The length of the first radiating strip 23 obtains a quarter of wavelength and resonates at a second high frequency band ranging from 4 GHz to 6 GHz. Antenna characteristic of the second radiating strip 25 of the radiating element 20 is similar to a monopole antenna. The length of the second radiating strip 25 obtains a quarter of wavelength and resonates at a third high frequency band ranging from 6 GHz to 8 GHz.

Furthermore, the L-shaped parasitic portion 31 of the parasitic element 30 can resonate at a lower frequency band of about 2.4 GHz which covers the bandwidth of wireless communications under Bluetooth by virtue of the L-shaped parasitic portion 31 being capacitively coupled with the level radiating portion of the radiating element 20.

Figure 2:
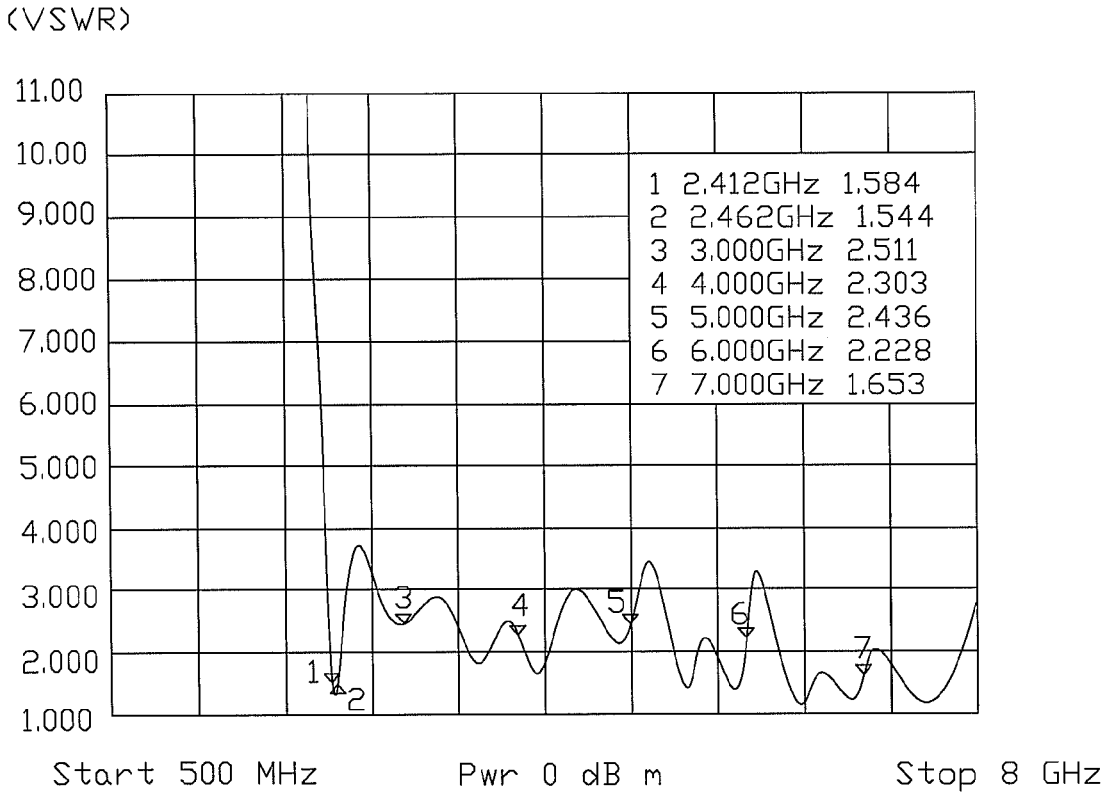
FIG. 2 is a test chart recording of Voltage Standing Wave Ratio (VSWR) of the multi-band antenna as a function of frequency.

In order to illustrate the effectiveness of the present invention, FIG. 2 sets a test chart recording of Voltage Standing Wave Ratio (VSWR) of the multi-band antenna 100 as a function of frequency. The multi-band antenna 100 respectively works in 2.412 GHz (mark 1), 2.462 GHz (mark 2), 3.000 GHz (mark 3), 4.000 GHz (mark 4), 5.000 GHz (mark 5), 6.000 GHz (mark 6) and 7.000 GHz (mark 7), and the values of the VSWR correspondingly are 1.584, 1.544, 2.511, 2.303, 2.436, 2.228 and 1.653, which conform to the design demand that the VSWR should be below the desirable value 2 or 3.

As described above, by arranging a parasitic element 30 spatially fencing the radiating element 20, the parasitic element 30 can resonate at a frequency band of about 2.4 GHz which covers the bandwidth of wireless communications under Bluetooth protocol due to the capacitance coupling effect. The design of the multi-band antenna 100 reducing a single antenna for working at Bluetooth frequency makes the multi-band antenna 100 have simple structure and smaller size, which can save space when assembled in a notebook.

What is claimed is:

1. A multi-band antenna, comprising:

a grounding plate;

a radiating element having a level radiating portion disposed a predetermined distance away from the grounding plate, a first connecting portion connecting the level radiating portion with the grounding plate, and a feeder point; and a parasitic element having a substantially L-shaped parasitic portion disposed a predetermined distance away from the grounding plate and a second connecting portion connecting a free end of the L-shaped parasitic portion with the grounding plate, the L-shaped parasitic portion being substantially at the same plane as and spatially fencing the level radiating portion to define a substantially L-shaped space for capacitively coupled with the level radiating portion, the second connecting portion and the first connecting portion being substantially disposed at the same side of the grounding plate, wherein the level radiating portion has a substantially n-shaped base, the n-shaped base has a long piece and two short pieces connecting two sides of the long piece, and the L-shaped parasitic portion spatially fences the long piece and one of the short pieces to form the L-shaped space, and wherein the short piece near the L-shaped parasitic portion extends towards the other short piece to form a first radiating strip.

2. The multi-band antenna as claimed in claim 1, wherein the first connecting portion is connected with the other short piece far away from the L-shaped parasitic portion, the short piece near the L-shaped parasitic portion extending towards the grounding plate to form a feeder portion where the feeder point is formed.

3. The multi-band antenna as claimed in claim 2, wherein the feeder portion extends towards the first connecting portion to form a second radiating strip.

4. A multi-band antenna, comprising:

a grounding plate;

a radiating element having a level radiating portion disposed a predetermined distance away from the grounding plate, a first connecting portion connecting the level radiating portion with the grounding plate, and a feeder point; and a parasitic element having a substantially L-shaped parasitic portion disposed a predetermined distance away from the grounding plate and a second connecting portion connecting a free end of the L-shaped parasitic portion with the grounding plate, the L-shaped parasitic portion being substantially at the same plane as and spatially fencing the level radiating portion to define a substantially L-shaped space for capacitively coupled with the level radiating portion, the second connecting portion and the first connecting portion being substantially disposed at the same side of the grounding plate, wherein the level radiating portion has a substantially n-shaped base, the n-shaped base has a long piece and two short pieces connecting two sides of the long piece, and the L-shaped parasitic portion spatially fences the long piece and one of the short pieces to form the L-shaped space, and wherein the first connecting portion is connected with the other short piece far away from the L-shaped parasitic portion, the short piece near the L-shaped parasitic portion extending towards the grounding plate to form a feeder portion where: the feeder point is formed.

5. The multi-band antenna as claimed in claim 4, wherein the feeder portion extends towards the first connecting portion to form a second radiating strip.

* * * * *